US009593911B2

(12) United States Patent
Jones et al.

(10) Patent No.: US 9,593,911 B2
(45) Date of Patent: Mar. 14, 2017

(54) BLANK FIRING SIMULATED FIREARM FOR USE IN COMBAT TRAINING

(75) Inventors: Giles D. Jones, Vail, AZ (US); Bradley Huang, Chino Hills, CA (US); Qingce Bian, Corona, CA (US); Christopher A. Tomlinson, Corona de Tucson, AZ (US); Peter M. Wallrich, Eugene, OR (US); William W. Price, Upland, CA (US); Jeffrey E. Decker, Vail, AZ (US)

(73) Assignee: Raytheon Company, Waltham, MA (US)

( * ) Notice: Subject to any disclaimer, the term of this patent is extended or adjusted under 35 U.S.C. 154(b) by 663 days.

(21) Appl. No.: 12/688,296

(22) Filed: Jan. 15, 2010

(65) Prior Publication Data

US 2010/0203483 A1 Aug. 12, 2010

Related U.S. Application Data

(60) Provisional application No. 61/205,184, filed on Jan. 16, 2009.

(51) Int. Cl.

| | |
|---|---|
| ***F41G 3/26*** | (2006.01) |
| ***F41A 5/18*** | (2006.01) |
| ***F41A 21/26*** | (2006.01) |
| ***F41A 21/28*** | (2006.01) |
| ***F41A 33/02*** | (2006.01) |

(52) U.S. Cl.

CPC ..... *F41G 3/2655* (2013.01); *F41A 5/18* (2013.01); *F41A 21/26* (2013.01); *F41A 21/28* (2013.01); *F41A 33/02* (2013.01); *F41G 3/2666* (2013.01)

(58) Field of Classification Search

CPC ..... F41A 33/00; F41A 33/02; F41A 33/06; F41A 21/10; F41A 21/12; F41A 5/18; F41G 3/2655; F41G 3/2666

USPC ..... 434/11–27

See application file for complete search history.

(56) References Cited

U.S. PATENT DOCUMENTS

| | | | | |
|---|---|---|---|---|
| 4,104,953 | A * | 8/1978 | Bard et al. | 89/14.5 |
| 5,829,180 | A * | 11/1998 | Leiter | 42/77 |
| 6,682,350 | B2 * | 1/2004 | Kehl et al. | 434/18 |
| 2007/0264616 | A1 * | 11/2007 | Namgung | 434/16 |
| 2009/0133310 | A1 * | 5/2009 | Wossner et al. | 42/77 |
| 2012/0129136 | A1 * | 5/2012 | Dvorak | 434/18 |

* cited by examiner

*Primary Examiner* — Timothy A Musselman

(57) ABSTRACT

According to one embodiment of the disclosure, a simulated firearm is provided that mimics the appearance of an actual firearm and is configured to fire blank ammunition. The simulated firearm also includes a light transmitter that transmits an infrared signal representative of a bullet fired from the actual firearm in response to firing of the blank ammunition.

20 Claims, 9 Drawing Sheets

56

| STANDARD AK-47 | |
|---|---|
| CHARACTERISTICS CALIBER | 7.62 mm |
| CARTRIDGE | 7.62x39 mm |
| SIGHTING RADIUS | 378 mm |
| LENGTH, OVERALL | 870 mm |
| BARREL LENGTH | 415 mm |
| MAGAZINE CAPACITY | 30 rds |
| SIGHTING RANGE | 800 m |
| WEIGHT WITH EMPTY MAGAZINE | 4300 g |
| WEIGHT WITH LOADED MAGAZINE | 4876 g |
| RATE OF FIRE | 600 rds/min |
| MUZZLE VELOCITY | 700 m/s |
| EFFECTIVE RANGE | 300 m |
| RIFLING GROOVES | 4 |
| RIFLED BORE | 378 mm |

54

| RAYTHEON MILES AK-47 | |
|---|---|
| CHARACTERISTICS CALIBER | 5.56 mm |
| CARTRIDGE | M200 BLANK |
| SIGHTING RADIUS | 378 mm |
| LENGTH, OVERALL | 870 mm |
| BARREL LENGTH | 415 mm |
| MAGAZINE CAPACITY | 30 rds |
| SIGHTING RANGE | 800 m |
| WEIGHT WITH EMPTY MAGAZINE | 4300 g |
| WEIGHT WITH LOADED MAGAZINE | 4876 g |
| RATE OF FIRE | 600 rds/min |
| MUZZLE VELOCITY | N/A |
| EFFECTIVE RANGE | 300 m |
| RIFLING GROOVES | NONE |
| RIFLED BORE | N/A |

*FIG. 10*

BLANK FIRING SIMULATED FIREARM FOR USE IN COMBAT TRAINING

RELATED APPLICATIONS

This application claims priority to U.S. Provisional Patent Application Ser. No. 61/205,184, entitled "BLANK FIRING SIMULATED FIREARM FOR A MULTIPLE INTEGRATED LASER ENGAGEMENT SYSTEM," which was filed on Jan. 16, 2009. U.S. Provisional Patent Application Ser. No. 61/205,184 is hereby incorporated by reference.

TECHNICAL FIELD OF THE DISCLOSURE

This disclosure generally relates to training devices, and more particularly, to a blank firing simulated firearm for use in combat training and a method for using the same.

BACKGROUND OF THE DISCLOSURE

Training is an important aspect of almost any useful endeavor. The act of training usually serves to enhance the skill of individuals by repetition and by developing appropriate responses to various situations that may be encountered. Soldiers may conduct various types of training exercises in order to prepare for various scenarios that may be encountered in an actual combat situation.

SUMMARY OF THE DISCLOSURE

According to one embodiment of the disclosure, a simulated firearm is provided that mimics the appearance of an actual firearm and is configured to fire blank ammunition. The simulated firearm also includes a light transmitter that transmits an infrared signal representative of a bullet fired from the actual firearm in response to firing of the blank ammunition.

Particular embodiments of the present disclosure may exhibit some, none, or all of the following technical advantages. For example, an advantage of one embodiment may include relatively more realistic training scenarios for military exercises. The simulated firearm mimics the appearance and sounds similar to an actual firearm. Trainees, therefore, may be encouraged to identify friendly or enemy combatants based upon the look and sound of the simulated firearm.

Other technical advantages will be readily apparent to one skilled in the art from the following figures, description, and claims.

BRIEF DESCRIPTION OF THE DRAWINGS

A more complete understanding of embodiments of the disclosure will be apparent from the detailed description taken in conjunction with the accompanying drawings in which:

FIG. 10 is a chart showing various characteristics of the simulated firearm of FIG. 1 compared with characteristics of an actual firearm of the same type;

DETAILED DESCRIPTION OF EXAMPLE EMBODIMENTS

It should be understood at the outset that, although example implementations of embodiments are illustrated below, various embodiments may be implemented using any number of techniques, whether currently known or not. The present disclosure should in no way be limited to the example implementations, drawings, and techniques illustrated below. Additionally, the drawings are not necessarily drawn to scale.

The multiple integrated laser engagement system (MILES) has been developed in order to provide realistic training scenarios for soldiers. The MILES system may generally include weapons such as firearms that are configured to emit a generally harmless line-of-sight type signal, such as infrared radiation from an light emitting diode (LED) or laser. Detectors that are receptive to these signals may be worn by other soldiers in order to simulate an actual impact from the firearm. Simulated firearms configured for use with MILES systems, however, often do not adequately simulate the appearance and audible noise made by actual firearms. Thus, soldiers may not be adequately trained to recognize firearms that may be used by enemy combatants. Thus, known simulated firearms used in MILES systems suffer in that they may not adequately simulate the appearance and sound of an actual enemy weapon.

Figure 1:
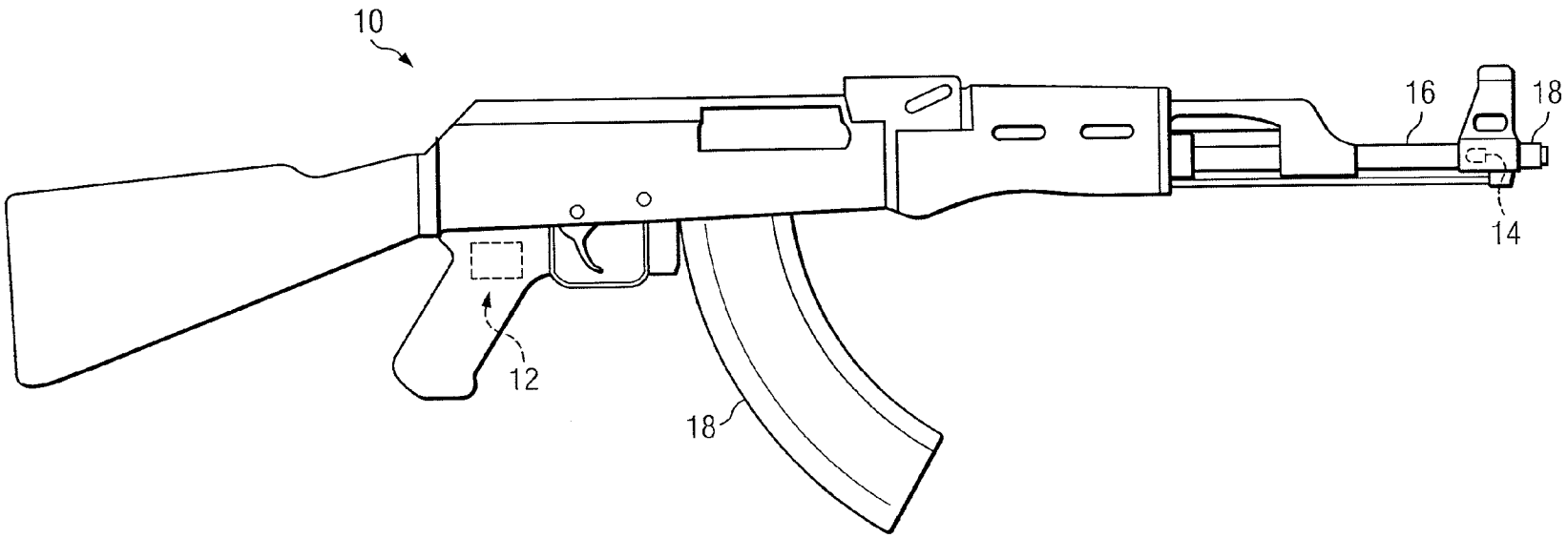
FIG. 1 is an illustration showing one embodiment of a simulated firearm according to the teachings of the present disclosure.

FIG. 1 is an illustration showing one embodiment of a simulated firearm 10 according to the teachings of the present disclosure. Simulated firearm 10 has a MILES device 12 and an associated light transmitter 14 concealed inside. The particular simulated firearm 10 shown mimics the appearance and operation of an AK-47 assault rifle. In other embodiments, simulated firearm 10 may be adapted to mimic the appearance and operation of any type of firearm for which military training exercises may be conducted.

Simulated firearm 10 simulates operation of an actual firearm by firing blank ammunition. Upon detonation of a blank round, MILES device 12 is triggered to transmit, using light transmitter 14, a light signal representative of a bullet fired from an actual firearm. In some embodiments, the transmitted light signal may be modulated with a digital signal that conveys information to a receiving MILES device for filtering spurious light signals and/or identifying the origin of the transmitted light signal.

Certain embodiments of simulated firearm 10 may provide an advantage in that soldiers may be adequately trained in the skill of recognizing an enemy combatant by the appearance and sound of the firearm used. Current warfare tactics are often conducted by combatants who may dress and act like civilians. Thus, recognition of weapons that these combatants use may be an important aspect of modern style military training. The simulated firearm 10 according to the teachings of the present disclosure provides the appearance and sound of an actual weapon for enhanced training of military personnel to recognize this type of combatants.

In one embodiment, simulated firearm 10 may be a converted form of its actual firearm counterpart. That is, simulated firearm 10 may include certain components of the actual firearm in which certain other components are retrofitted, replaced, and/or modified in order to make simulated firearm 10 suitable for use in a training exercise. For example, simulated firearm 10 may include certain retrofit components, such as a barrel 16, a muzzle break 18, and/or a magazine 20, that render simulated firearm 10 incapable of firing actual ammunition. Components such as these will be discussed in detail below.

Certain embodiments of simulated firearm 10 that has been created from an actual firearm may provide other benefits, such as the relatively easy adaptation of commercial-off-the-shelf (COTS) variants. Actual firearms, such as the AK-47 assault rifle may be retrofitted with various accessories that are readily available. For example, a metal stock that is configured for use with the AK-47 assault rifle, may be retrofitted with simulated firearm 10. Thus, personnel may be trained to visually recognize an AK-47 assault rifle that has been configured with one or more of its readily available variants.

Figure 2:
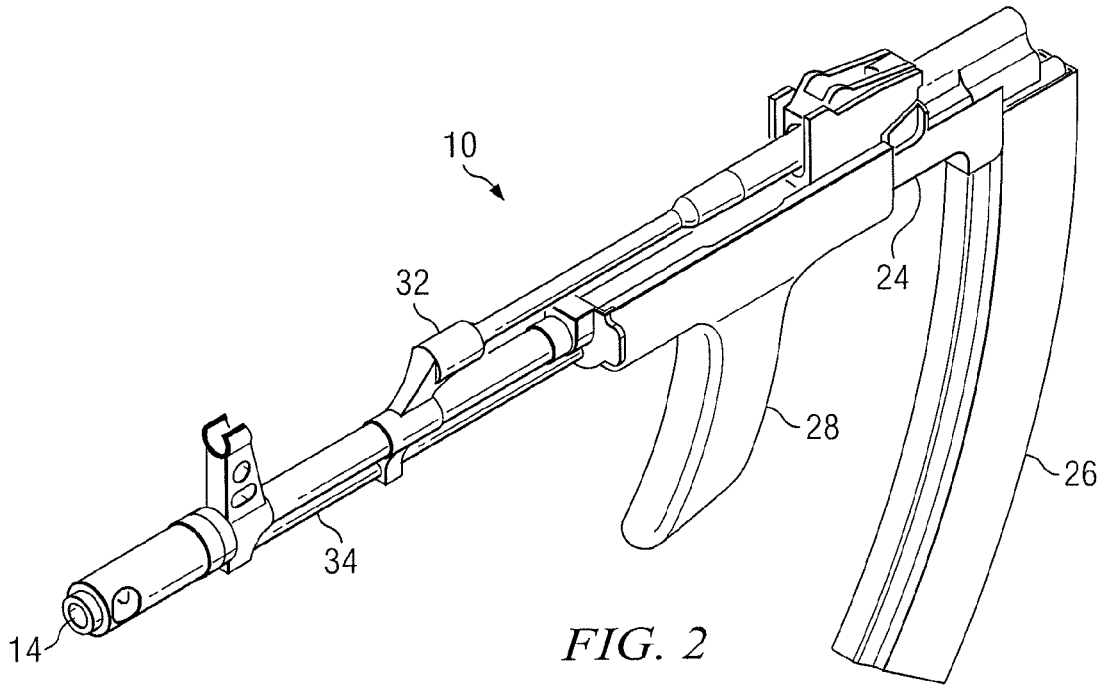
FIG. 2 is a perspective view of the simulated firearm in which certain components are removed to reveal several other components.

FIG. 2 is a perspective view of the simulated firearm 10 in which certain components are removed to reveal several of its other components. Components of simulated firearm 10 include a lower receiver 24 having a receptacle for insertion of a magazine 26, a grip 28, a gas return nozzle 32, and a hollow tube 34. Hollow tube 34 may be provided for routing of wires (not shown) that couple MILES device 12 (FIG. 1) to light transmitter 14. In this manner, wires may be concealed from view.

Figure 3:
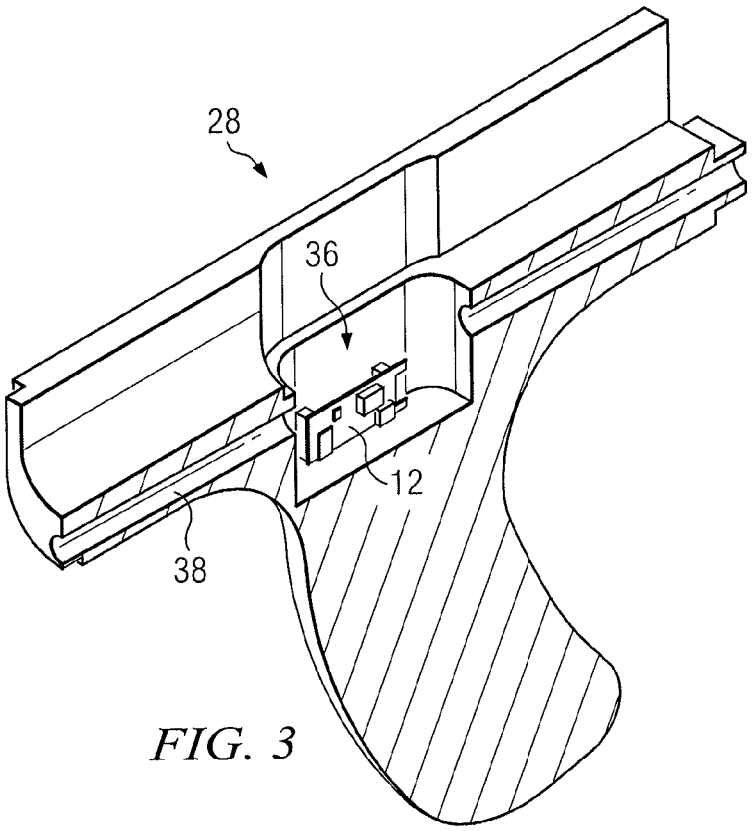
FIG. 3 is a perspective view of the grip of the simulated firearm of FIG. 1.

FIG. 3 is a perspective view of the grip 28 of the simulated firearm 10 of FIG. 1. As shown, grip 28 has a cavity 36 for housing MILES device 12 and a channel 38 for routing wires to light transmitter 14. In this manner, MILES device 12 may be concealed from view inside of simulated firearm 10.

Figure 4:
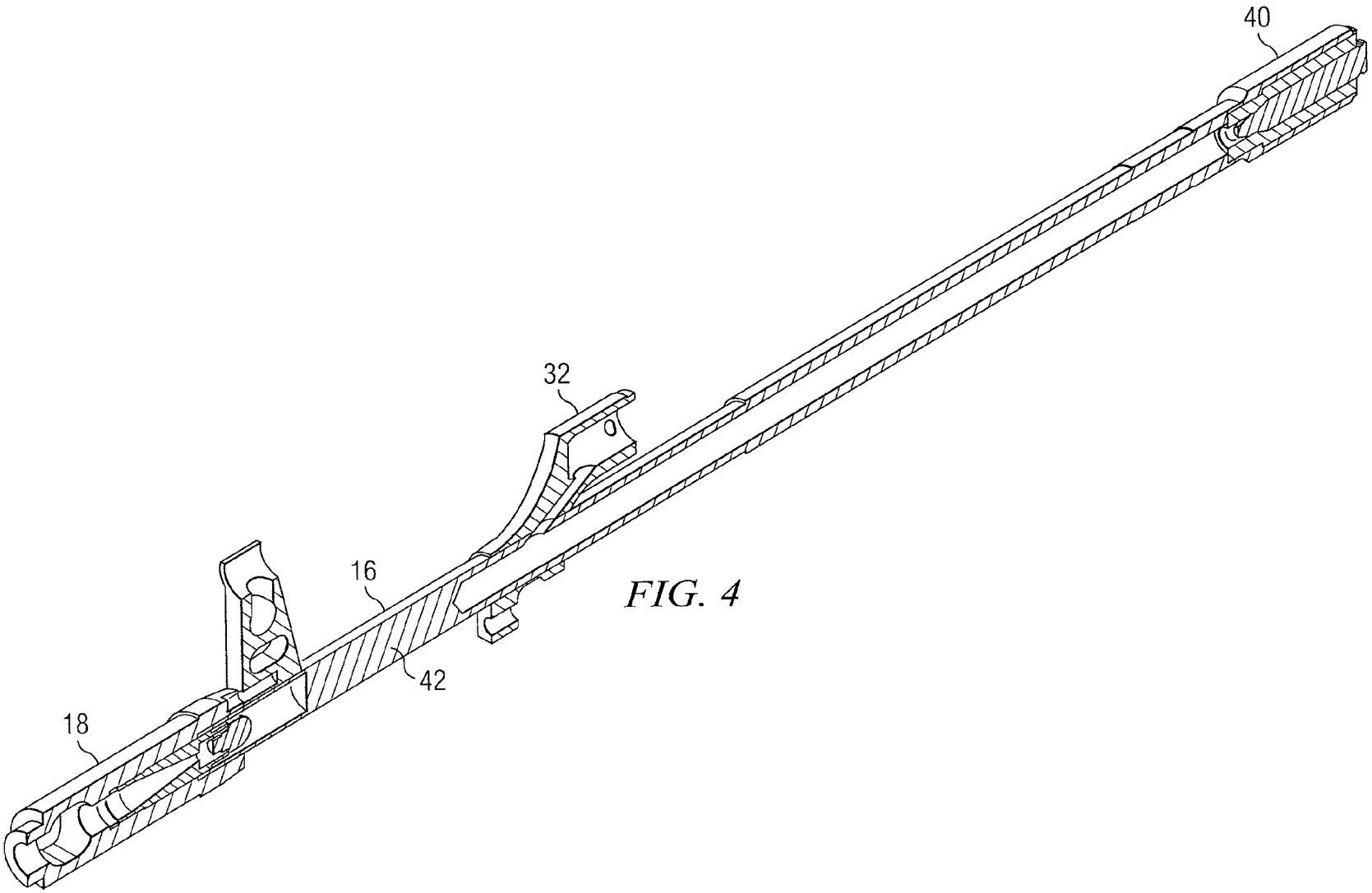
FIG. 4 is a perspective, cut-away view of the barrel, muzzle break, gas return nozzle, and a customized breach of the simulated firearm of FIG. 1.

FIG. 4 is a perspective, cut-away view of the barrel 16, muzzle break 18, gas return nozzle 32, and a customized breach 40 that may be implemented on the simulated firearm 10 of FIG. 1. Barrel 16 is a retrofit type that mimics the appearance of an actual barrel, but is incapable of firing actual ammunition. For example, barrel 16 may be milled from metal stock that is ill-suited for handling physical forces generated by an actual round. As another example, the wall of barrel 16 may be sufficiently thin to crack under the pressure exerted by an actual round. In one embodiment, barrel 16 includes a plug 42 that diverts pneumatic pressure from a blank round to gas return nozzle 32 for actuating the gas expansion chamber of simulated firearm 10. In this manner simulated firearm 10 may have an action simulating that of its actual firearm counterpart.

Figure 5A:
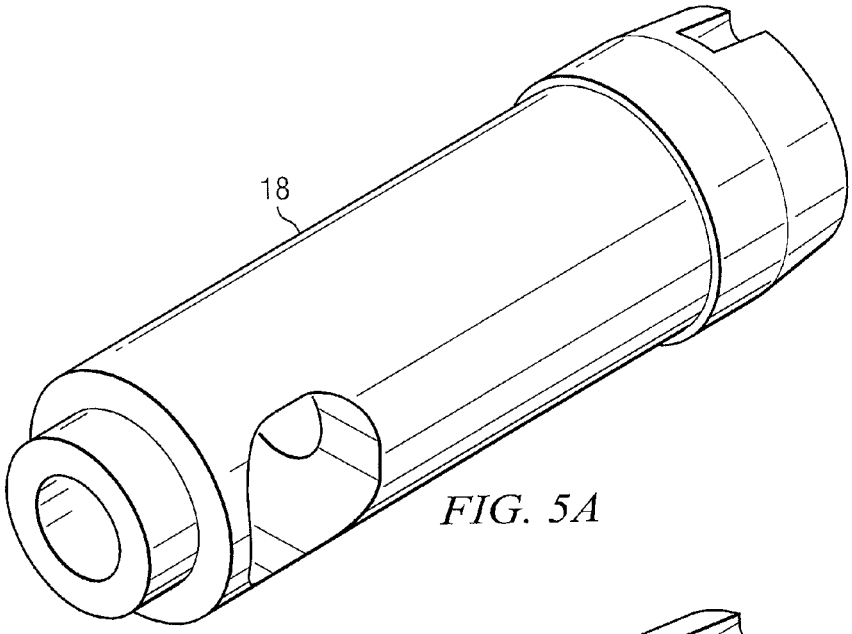
FIGS. 5A and 5B are perspective and perspective, cut-away views, respectively of the muzzle break configured on the simulated firearm of FIG. 1.
Figure 5B:
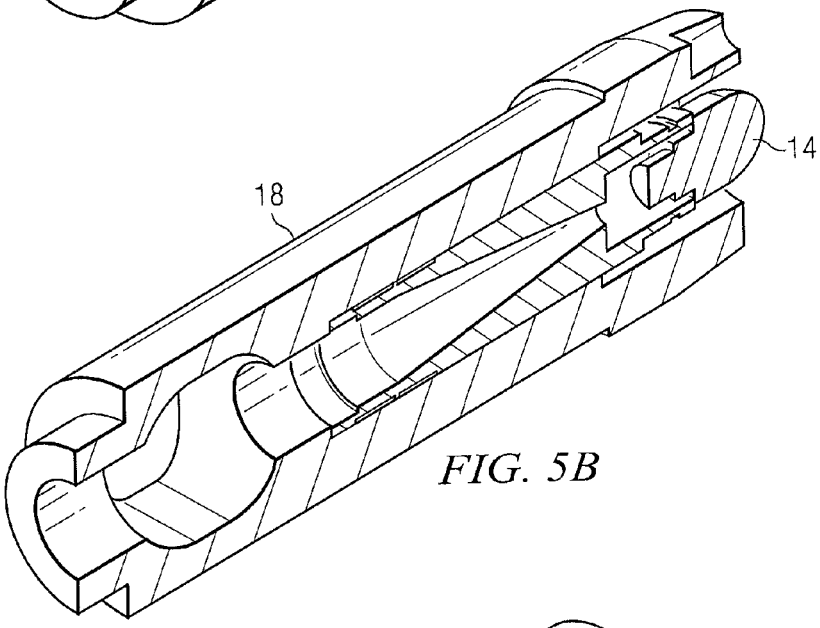

FIGS. 5A and 5B are perspective, cut-away views of the muzzle break 18 configured on the simulated firearm 10 of FIG. 1. As shown, light transmitter 14 is configured in muzzle break 18 such that it is concealed from outside of simulated firearm 10. Light transmitter 14 may be recessed in muzzle break 18 for lens protection. Light transmitter 14 may be any light generating device, such as a light emitting diode, or a laser. Although the present embodiment describes light transmitter 14 configured in muzzle break 18; in other embodiments, it may be configured in any component of firearm 10 that provides its concealment and provides an opening for emitting light in a direction similar to the boresight of barrel 16.

Figure 6:
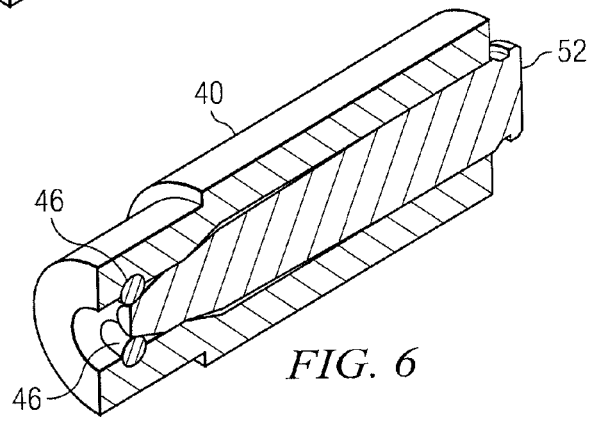
FIG. 6 is an enlarged, cut-away view of the breach in which a blank round is disposed.

FIG. 6 is an enlarged, cut-away view of the breach 40 in which a blank round 52 is disposed. Breach 40 is configured with dowel pins 46 made of hardened metal or other suitable material. Dowel pins 46 are configured in breach such that only blank rounds 52 may be inserted into a battery position within breach 40. Dowel pins 46 may also serve to inhibit movement of a projectile through barrel 16.

Figure 7A:
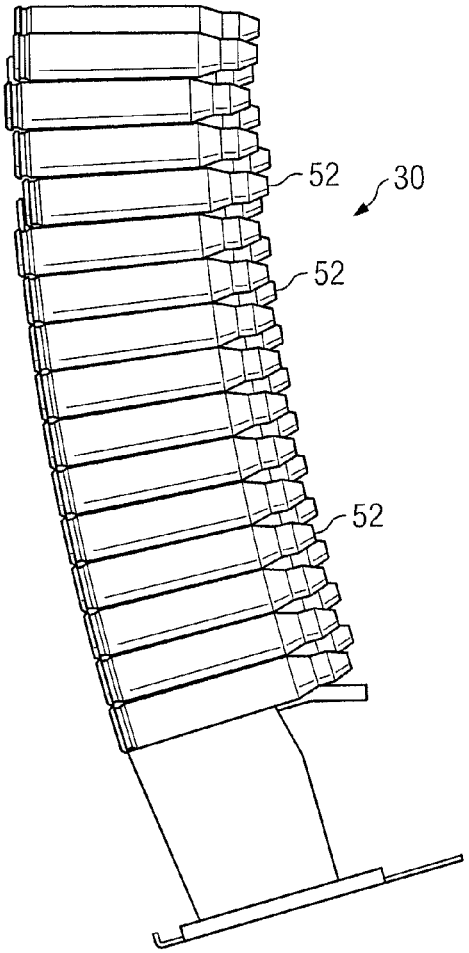
FIGS. 7A and 7B are cross-sectional, and side elevational views, respectively of one embodiment of a magazine that may be used with the simulated firearm of FIG. 1.
Figure 7B:
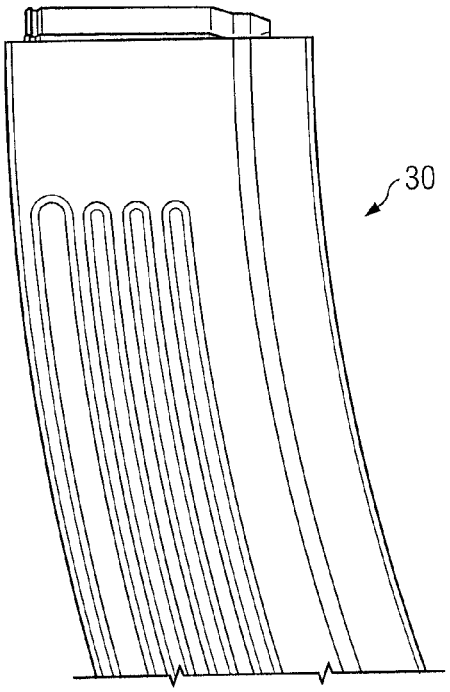

FIGS. 7A and 7B are cross-sectional, and side elevational views, respectively, of one embodiment of a magazine 30 that may be used with the simulated firearm 10 of FIG. 1. Magazine 30 is dimensioned to only allow insertion of blank rounds 52 inside. In one embodiment, the magazine receptacle configured in the lower receiver of simulated firearm 10 may be dimensioned to only accept magazine 20 while inhibiting insertion of other magazines that accept actual ammunition.

Figure 8A:
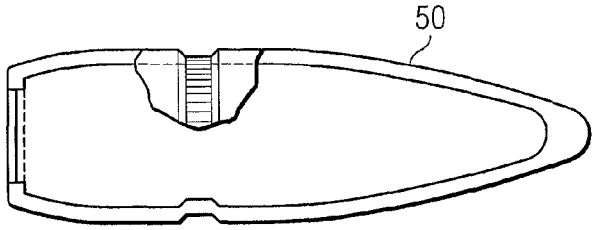
FIGS. 8A and 8B are side views of an actual projectile and round, respectively, that may be fired by an actual firearm.
Figure 8B:
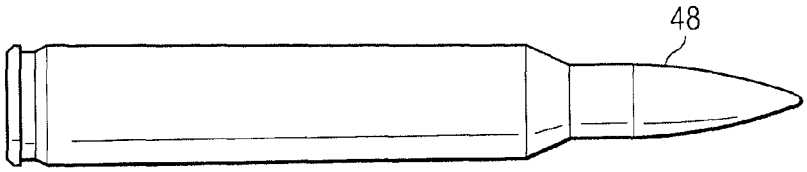
Figure 9A:
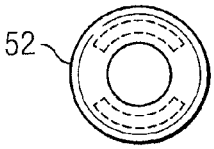
FIGS. 9A, 9B, and 9C are an end view and side views, respectively of one embodiment of a blank round that may be fired by the simulated firearm of FIG. 1.
Figure 9B:
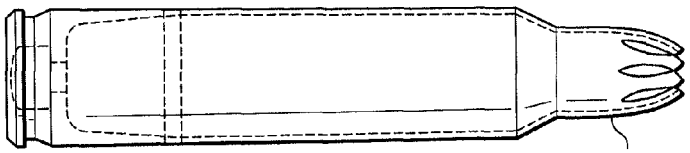
Figure 9C:
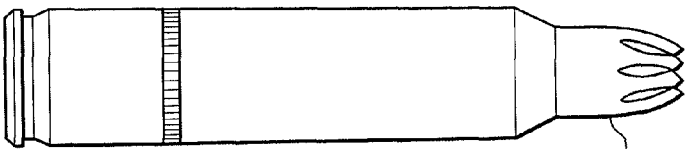

FIGS. 8A and 8B are side views of an actual projectile 48 and round 50, respectively, that may be fired by an actual firearm, and FIGS. 9A, 9B, and 9C are an end view and side views, respectively, of one embodiment of a blank round 52 that may be fired by the simulated firearm 10 of FIG. 1. As shown, blank round 52 is shorter in length than actual round 50. Thus, breach 40 (FIG. 6) and magazine 30 (FIGS. 7A and 7B) may be dimensioned to accept insertion of blank round 52 while inhibiting insertion of actual round 50 due to at least the difference in length between the two.

FIG. 10 is a chart showing various characteristics 54 of simulated firearm 10 compared with characteristics 56 an actual firearm of the same type. As shown, simulated firearm 10 is not only designed to mimic the appearance of an actual firearm, but may have operational characteristics 54 that may be relatively comparable to those of its actual firearm counterpart.

Figure 11:
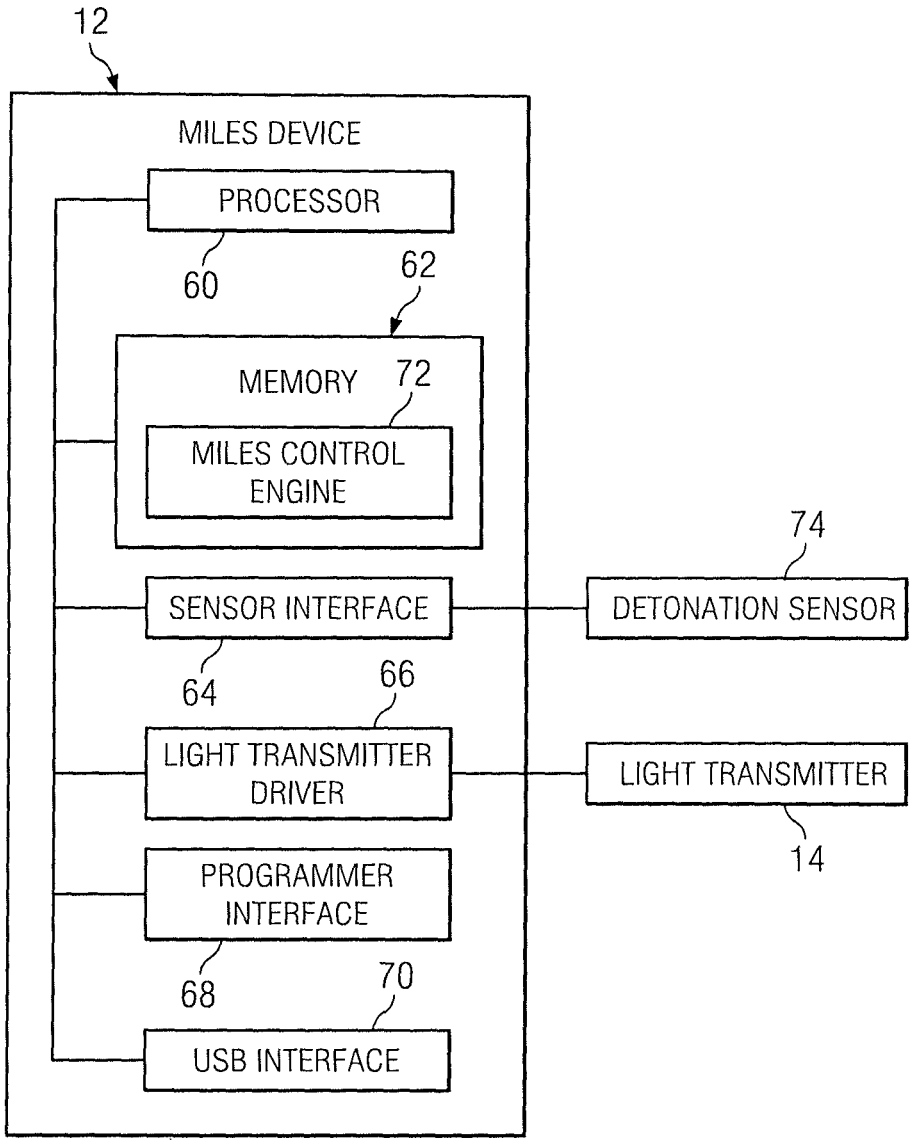
FIG. 11 is a block diagram of one embodiment of a multiple integrated laser engagement system (MILES) device that may be configured on the simulated firearm of FIG. 1.

FIG. 11 is a block diagram of one embodiment of the MILES device 12 that may be configured on the simulated firearm 10 of FIG. 1. Although the present embodiment describes a training apparatus implemented with a MILES device, other embodiments may include any type of device that transmits light signals representing ammunition that may be fired from its actual firearm counterpart.

MILES device 12 includes a processor 60 and a memory 62, a sensor interface 64, a light transmitter driver 66, a programmer interface 68, and a USB interface 70. In one embodiment, processor 60 comprises an embedded microcontroller in which it, memory 62, sensor interface 64, light transmitter driver 66, and programmer interface 68 are sufficiently small to fit on a printed circuit board that is approximately 1 inch by 1 inch in size.

Memory 62 stores a MILES control engine 72 comprising instructions that, when executed on processor 60, perform the various functions associated with operation of simulated firearm 10. In other embodiments, MILES device 12 may include any suitable type of logic, such as hardware, software, and/or other logic. For example, logic may be embodied on a field programmable gate array (FPGA) or on a application specific integrated circuit (ASIC). The logic may also be embedded within any other suitable medium without departing from the scope of the invention.

The logic may be stored on a medium such as the memory 62. Memory 62 may comprise one or more tangible, computer-readable, and/or computer-executable storage medium. Examples of the memory 62 include computer memory (for example, Random Access Memory (RAM) or Read Only Memory (ROM)), mass storage media (for example, a hard disk), removable storage media (for example, a Compact Disk (CD) or a Digital Video Disk (DVD)), database and/or network storage (for example, a server), and/or other computer-readable medium.

Although the illustrated embodiment provides one embodiment of a MILES device 12 that may be used with other embodiments, such other embodiments may additionally utilize architectures other than described above. Additionally, embodiments may also employ multiple processors or other processors networked together in a computer network. For example, multiple MILES devices 12 may be networked through the Internet and/or in a client server network. Embodiments may also be used with a combination of separate computer networks each linked together by a private or a public network.

Sensor interface 64 receives a firing signal from a detonation sensor 74 indicative of detonation of a round of ammunition. Detonation sensor 74 detects detonation of ammunition in any suitable manner. In one embodiment, detonation sensor 74 may be a shock sensor, an audio detector, a thermal sensor, or a pressure sensor that detects physical characteristics of firearm 10 due to detonation of ammunition. In other embodiments, detonation sensor 74 may be mechanically coupled to the trigger of simulated firearm 10. Upon receipt of the firing signal, processor 60 instructs light transmitter to generate a digital light signal through light transmitter interface 68. In this manner, the transmitted digital light signal may be coordinated with operation of the simulated firearm 10. Programmer interface 68 may be included to provide modifications to MILES control engine 72 during its deployment. USB interface 70 may be used to retrieve and/or store data in memory 62.

Figure 12:
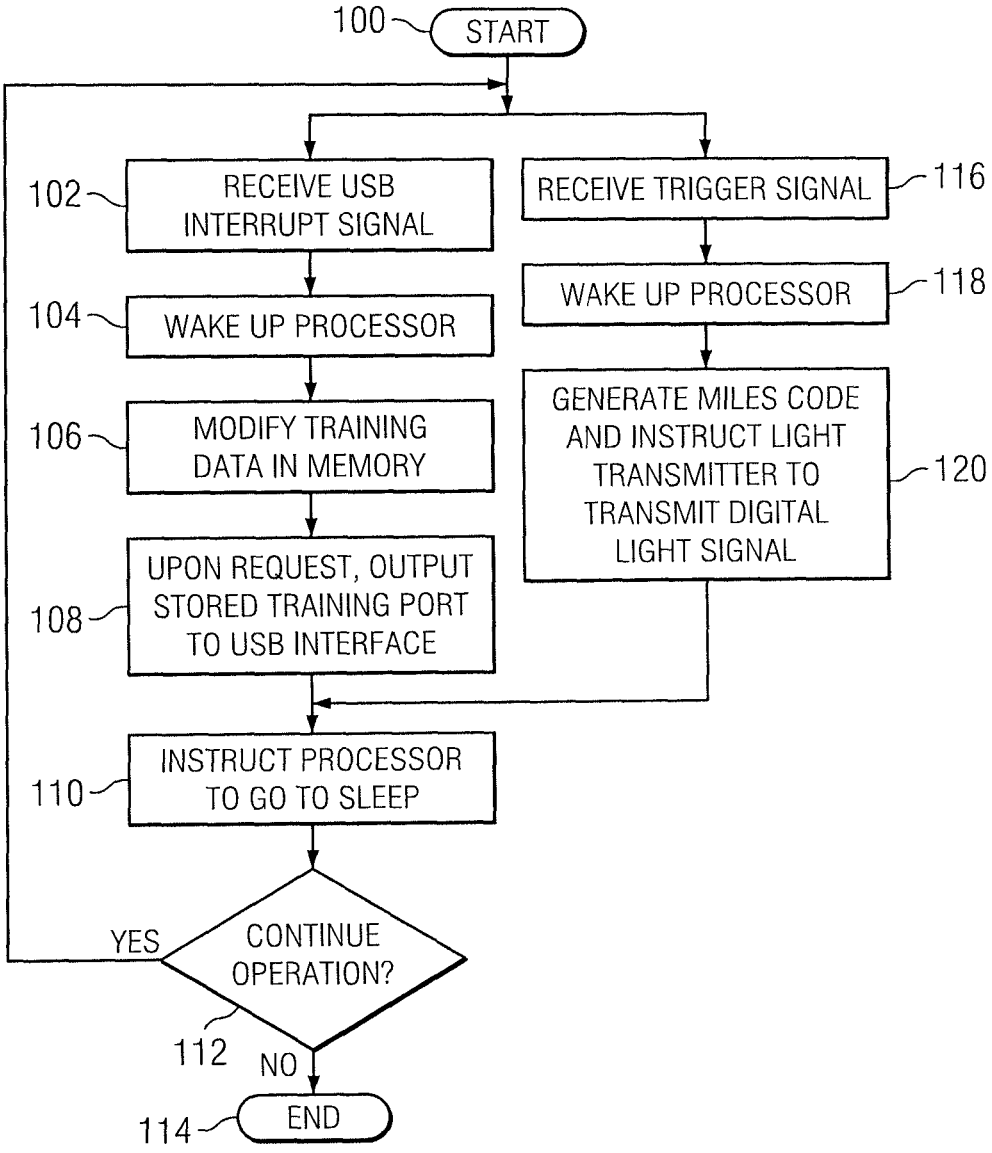
FIG. 12 is a flowchart showing one embodiment of a series of steps that the MILES device of FIG. 11 may perform during its operation.

FIG. 12 is a flowchart showing one embodiment of a series of steps that MILES device 12 may perform during its operation. In step 100, the process is initiated. In this initial step, processor 60 is in a sleep state.

Steps 102 through 108 describe the operation of MILES device 12 to modify its stored training data. In step 102, processor 60 receives a USB interrupt signal from USB interface 70. The USB interrupt signal may be generated as the result of coupling processor 60 to an external computing device, such as a memory stick or another computing system through USB interface 70.

In step 104, processor 60 wakes from its sleep state. The sleep state of processor 60 generally refers to a mode of operation in which processor is not actively processing instructions stored in memory. The sleep state causes MILES device 12 to exhibit reduced energy consumption for prolonged battery life.

In step 106, processor 60 receives training data from USB interface 70 and modifies stored training data in memory 62 according to data from USB interface 70. Examples of training data may include the name and identity of training person that operates simulated firearm 10, the training scenario to be conducted, and/or various performance characteristics that may be associated with the simulated firearm 10.

In step 108, processor 60 transmits currently stored training data through USB interface 70 upon request. For example, a user may wish to verify that training data has be successfully modified in memory 62. Thus, processor 60 may serve stored training data to an external computer device through USB interface 70 to ensure proper modification of training data.

In step 110, processor 60 is instructed to return to the sleep state.

In step 112, operation of MILES device 12 may be continued to perform other functions its operation may be halted. If continued operation of MILES device 12 is desired, processing continues at step 102 or 116. If use of MILES device 12 is no longer needed or desired, processing is halted and the process ends at step 114.

Steps 116 through 120 describe operation of MILES device to transmit a digital light signal in response to detonation of a round of blank ammunition by simulated firearm 10. In step 116, processor 60 receives a signal from sensor interface 64. The signal may be generated by any type of sensor that detects detonation of a round of blank ammunition. For example, the signal may be generated by a detonation sensor 24 that is sensitive to one or more physical characteristics of firearm 10 during detonation, such as physical shock, audible noise, thermal changes, pressure changes in barrel 16, and/or actuation of the trigger.

In step 118, wakes from its sleep state.

In step 120, processor 60 instructs light transmitter 14 to transmit a digital light signal. In one embodiment, processor 60 modulates the transmitted digital light signal with a digital signal conforming to the MILES protocol. Modulated signals such as these may include information about the identity of the simulated firearm's user, expected performance criteria of its actual firearm counterpart, or other information that may be received and processed by a receiving MILES device.

Following step 120, processor 60 may re-enter the sleep mode in step 110. Operation of MILES device 12 may continue by repeating the previously described steps, or its operation may be halted in step 114.

Modifications, additions, or omissions may be made to the method without departing from the scope of the invention. The method may include more, fewer, or other acts. For example, processor 60 may be void of a sleep state if reduced battery consumption during its operation is not needed or desired.

Although several embodiments have been illustrated and described in detail, it will be recognized that substitutions and alterations are possible without departing from the spirit and scope of the present disclosure, as defined by the following claims.

What is claimed is:

1. A training apparatus comprising:

a simulated firearm that mimics an appearance of an actual firearm and that is operable to fire tangible blank ammunition while being incapable of firing live ammunition, the simulated firearm comprising one or more components of the actual firearm;

a pin configured in a chamber of the simulated firearm, the pin configured to inhibit the firing of the live ammunition, wherein the chamber is configured with at least one hole in which the pin is inserted, the at least one hole configured to weaken the chamber such that the chamber destructs if the live ammunition is used in the simulated firearm; and a multiple integrated laser engagement system (MILES) device comprising an electronic circuit and a light transmitter that are concealed from view inside the simulated firearm, the MILES device operable to transmit an infrared signal modulated with a digital signal representative of a bullet fired from the actual firearm in response to firing of the tangible blank ammunition.

2. The training apparatus of claim 1, wherein the light transmitter is configured inside a muzzle break of the simulated firearm and the electronic circuit is disposed in a grip of the simulated firearm.

3. The training apparatus of claim 1, wherein the electronic circuit comprises:

a memory configured to store a MILES control engine;

a sensor interface configured to receive a firing signal indicative of firing of the tangible blank ammunition;

a light transmitter driver; and a processor configured, upon receipt of the firing signal, to instruct the light transmitter to transmit the infrared signal through the light transmitter driver.

4. A training apparatus comprising:

a simulated firearm that mimics an appearance of an actual firearm and that is configured to fire tangible blank ammunition and is incapable of firing live ammunition;

a pin configured in a chamber of the simulated firearm, the pin configured to inhibit the firing of the live ammunition, wherein the chamber is configured with at least one hole in which the pin is inserted, the at least one hole configured to weaken the chamber such that the chamber destructs if the live ammunition is used in the simulated firearm;

a light transmitter inside a muzzle of the simulated firearm and concealed from view inside the simulated firearm, the light transmitter configured to transmit an infrared signal representative of a bullet fired from the actual firearm in response to firing of the tangible blank ammunition, wherein the infrared signal is modulated with a digital signal; and an electronic circuit configured to modulate the infrared signal with the digital signal and to drive the light transmitter, the electronic circuit being inside the simulated firearm and concealed from view from outside of the simulated firearm.

5. The training apparatus of claim 4, wherein the digital signal conforms to a multiple integrated laser engagement system (MILES) protocol, and wherein the modulated infrared signal includes at least one of:

information about an identity of a user of the simulated firearm, or information about an expected performance criteria of the actual firearm.

6. A training apparatus comprising:

a simulated firearm that mimics an appearance of an actual firearm and that is configured to fire tangible blank ammunition and is incapable of firing live ammunition;

a pin configured in a chamber of the simulated firearm, the pin configured to inhibit the firing of the live ammunition, wherein the chamber is configured with holes in which the pin is inserted, the holes configured to weaken the chamber such that the chamber destructs if the live ammunition is used in the simulated firearm;

a light transmitter inside a muzzle of the simulated firearm and concealed from view inside the simulated firearm, the light transmitter configured to transmit an infrared signal representative of a bullet fired from the actual firearm in response to firing of the tangible blank ammunition; and an electronic circuit configured to drive the light transmitter, the electronic circuit being concealed from view from outside of the simulated firearm.

7. The training apparatus of claim 6, wherein the light transmitter and the electronic circuit comprise a multiple integrated laser engagement system (MILES) device.

8. The training apparatus of claim 7, wherein the electronic circuit comprises:

a memory configured to store a MILES control engine;

a sensor interface configured to receive a firing signal indicative of firing of the tangible blank ammunition;

a light transmitter driver; and a processor configured, upon receipt of the firing signal, to instruct the light transmitter to transmit the infrared signal through the light transmitter driver.

9. The training apparatus of claim 6, wherein the simulated firearm comprises one or more components of the actual firearm.

10. The training apparatus of claim 6, wherein the simulated firearm mimics the appearance of a military firearm.

11. The training apparatus of claim 6, wherein the light transmitter is configured wholly inside a muzzle break of the simulated firearm.

12. The training apparatus of claim 6, wherein the electronic circuit is disposed in a grip of the simulated firearm, and wherein the training apparatus further comprises a magazine configured to be inserted into the simulated firearm.

13. A training method comprising:

firing a tangible blank round from a simulated firearm that mimics an appearance of an actual firearm and that is incapable of firing live ammunition;

inhibiting the firing of the live ammunition by the simulated firearm using a pin configured in a chamber of the simulated firearm, wherein the chamber is configured with at least one hole in which the pin is inserted, the at least one hole weakening the chamber such that the chamber destructs if the live ammunition is used in the simulated firearm;

transmitting, using a light transmitter configured inside a muzzle of the simulated firearm and concealed from view inside the simulated firearm, an infrared signal representative of a bullet fired from the actual firearm in response to the firing of the tangible blank round, wherein the infrared signal is modulated with a digital signal;

modulating, using an electronic circuit that is inside the simulated firearm and concealed from view from outside of the simulated firearm, the infrared signal with the digital signal; and driving the light transmitter using the electronic circuit.

14. The method of claim 13, wherein the digital signal conforms to a multiple integrated laser engagement system (MILES) protocol, and wherein the modulated infrared signal includes at least one of:

information about an identity of a user of the simulated firearm, or information about an expected performance criteria of the actual firearm.

15. A training method comprising:

firing a tangible blank round from a simulated firearm that mimics an appearance of an actual firearm and that is incapable of firing live ammunition;

inhibiting the firing of the live ammunition by the simulated firearm using a pin configured in a chamber of the simulated firearm, wherein the pin is inserted in at least one hole configured in the chamber, the at least one hole weakening the chamber such that the chamber destructs if the live ammunition is used in the simulated firearm;

transmitting, using a light transmitter configured inside a muzzle of the simulated firearm and concealed from view inside the simulated firearm, an infrared signal representative of a bullet fired from the actual firearm in response to the firing of the tangible blank round; and driving the light transmitter using an electronic circuit that is concealed from view from outside of the simulated firearm.

16. The method of claim 15, wherein the light transmitter and the electronic circuit comprise a multiple integrated laser engagement system (MILES) device.

17. The method of claim 15, wherein the simulated firearm comprises one or more components of the actual firearm.

18. The method of claim 15, wherein the simulated firearm mimics the appearance of a military firearm.

19. The method of claim 15, further comprising configuring the light transmitter inside a muzzle break of the simulated firearm.

20. The method of claim 15, wherein the light transmitter is disposed in a grip of the simulated firearm, and wherein the simulated firearm further comprises a magazine configured to be inserted into the simulated firearm.

* * * * *